US005096089A

United States Patent [19]

McLaughlin

[11] Patent Number: 5,096,089

[45] Date of Patent: Mar. 17, 1992

[54] DISPOSABLE GLOVE DISPENSER

[76] Inventor: David T. McLaughlin, 279 Highgate Ave., Worthington, Ohio 43085

[21] Appl. No.: 670,565

[22] Filed: Mar. 18, 1991

[51] Int. Cl.[5] ..... B65H 3/58

[52] U.S. Cl. ..... 221/26; 221/46; 221/62; 221/63; 221/197; 221/281; 221/287

[58] Field of Search ..... 221/26, 27, 28, 45, 221/46, 61, 62, 63, 197, 281, 287, 302, 283

[56] References Cited

U.S. PATENT DOCUMENTS

| | | | |
|---|---|---|---|
| 2,341,119 | 2/1944 | Rost | 221/26 X |
| 4,537,330 | 8/1985 | Gelbard | 221/26 |
| 4,844,293 | 7/1989 | McLaughlin | 221/197 X |
| 4,863,084 | 9/1989 | Nabozny | 221/26 X |

FOREIGN PATENT DOCUMENTS

| | | | |
|---|---|---|---|
| 2035264 | 6/1980 | United Kingdom | 221/26 |

*Primary Examiner*—David H. Bollinger

*Attorney, Agent, or Firm*—Francis T. Kremblas, Jr.

[57] ABSTRACT

A dispensing apparatus for thin, disposable plastic gloves wherein the gloves may be reliably removed one at a time in a simple manner. The apparatus comprises a generally rectangular enclosure for housing a removably mounted packet containing a plurality of gloves. The gloves are arranged in closely spaced, parallel relationship to one another for removal, one at a time, through an exit opening provided through the walls of the enclosure. Each glove is provided with a weakened tear line across the wrist portion. The packet of gloves includes a mounting strip which extends across the upper wrist portion of the stack of gloves and is fixed to each glove above the tear line. The mounting strip cooperates with means formed in the enclosure to releasably fix the packet within the enclosure. Each glove may be removed by exerting a downward force through the exit opening on the outermost glove sufficient to separate the glove along the tear line from the remaining gloves in the packet.

2 Claims, 1 Drawing Sheet

DISPOSABLE GLOVE DISPENSER

BACKGROUND ART

Relatively thin disposable polyethylene gloves have a variety of uses and applications in the present market place and have been available for many years. However, one of the major problems to expanding the use or availability of such gloves resides in the manner in which they have been packaged and the ease and reliability of their removal one at a time from the dispenser.

The intended disposable nature of these types of articles requires maintaining a low cost per glove. Therefore the dispensing unit must protect the gloves from the surrounding environment and also provides for simple low cost manufacture and reliable removal of one glove at a time. Inadvertent removal of more than one glove at a time leads to wastage and raises the effective unit cost of each glove to the customer.

There have been prior attempts to provide a dispensing device which adequately protects the gloves from outside elements and yet still permits convenient one at a time retrieval of each glove. One example of such a unit is found in my prior U.S. Pat. No. 4,844,293 issued July 4, 1989. However, further improvements are still sought by those skilled in the art to reduce the cost of the enclosure means and to improve the reliability of one glove at a time retrieval. Typical applications which could benefit from a reliable, yet inexpensive dispensing unit which can be conveniently disposed in a more or less permanent location include emergency vehicles, hospitals, food processing plants, restaurant food preparations, laboratories and industrial plants.

SUMMARY OF THE INVENTION

The present invention relates generally to disposable glove dispensers and particularly to an improved glove dispenser and glove packet arrangement which promotes more reliable and efficient dispensing of one glove at a time in a relatively low cost manner.

In accordance with the present invention, the disposable gloves are packaged in the form of a packet which is removably mounted within a protective enclosure means from which the gloves may be reliably and conveniently retrieved one at a time by users.

The packet of gloves according to the present invention comprises a plurality of disposable gloves disposed in an aligned parallel relationship to one another and to the walls of the enclosure. Each glove includes a perforated tear line across the upper portion of the glove conforming to the user's wrist. A relatively rigid mounting strip is disposed across the wrist portion of the outermost glove and commonly fixed to each glove in the stack above the perforated tear line. Preferably the stacked and parallel aligned gloves are arranged in the packet by folding the finger portions of the stack of gloves as a whole upwardly over the palm portion to conserve space and also expose a portion of the palm of the outermost glove to the user for pulling off one glove at a time.

Preferably the gloves are maintained in this packet configuration by a thin flexible outer cover or envelope which is also secured to the relatively rigid mounting strip. The outer cover is provided with an opening, preferably near or along its bottom portion, which exposes a portion of the outermost glove in the stack to permit removal by the user.

The enclosure housing the packet of gloves is formed by a three sided rear wall means pivotally connected at its lower bottom edge to a front wall or cover between an open and closed position.

The packet is removably mounted as a whole into the enclosure means when the front and rear walls are pivoted to the open position. The front and rear walls are provided with means to releasably fix the packet within the enclosure upon returning the front cover and rear wall portion to the closed position. An exit window or opening is provided in the enclosure to expose a portion of the outermost glove to permit removal one glove at a time.

Figure 1:
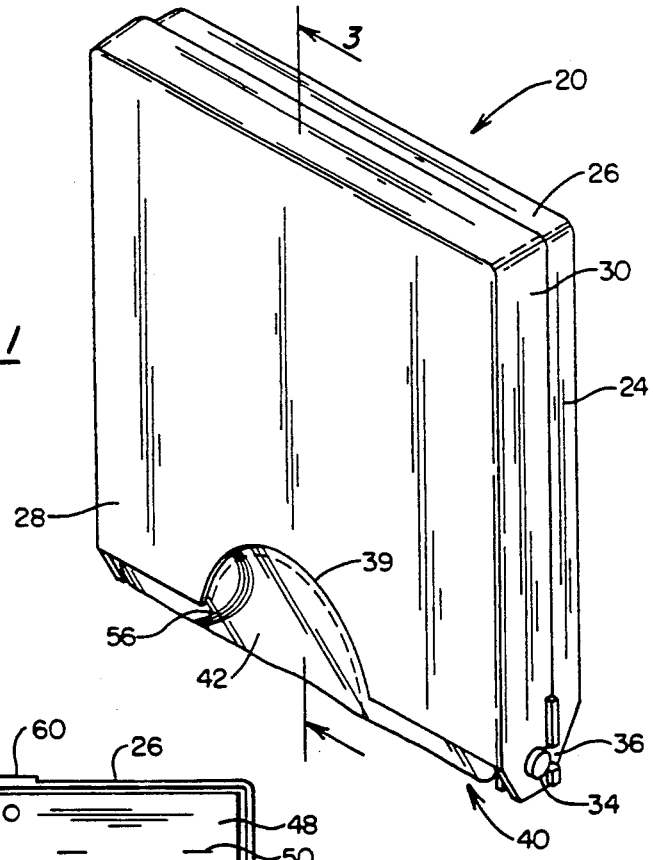
FIG. 1 is a perspective view of a disposable glove dispenser constructed in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF PREFERRED EMBODIMENT

Figure 2:
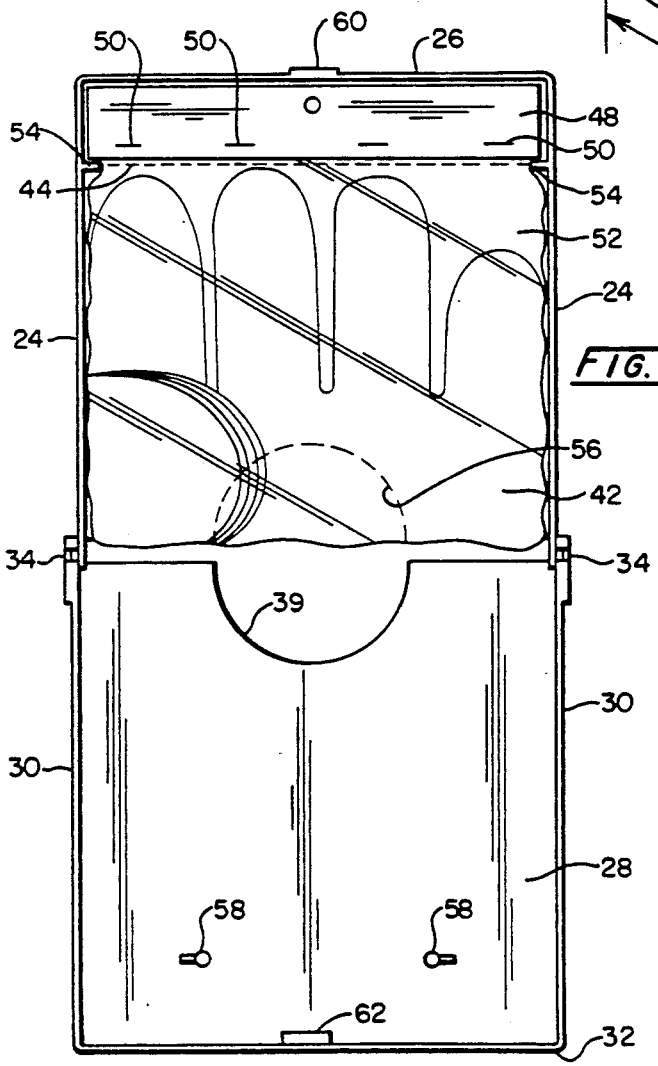
FIG. 2 is a front elevational view of the dispense shown in FIG. 1 illustrating the front wall cover pivoted to the open position exposing a portion of the packet of gloves which is mounted within the enclosure means.
Figure 3:
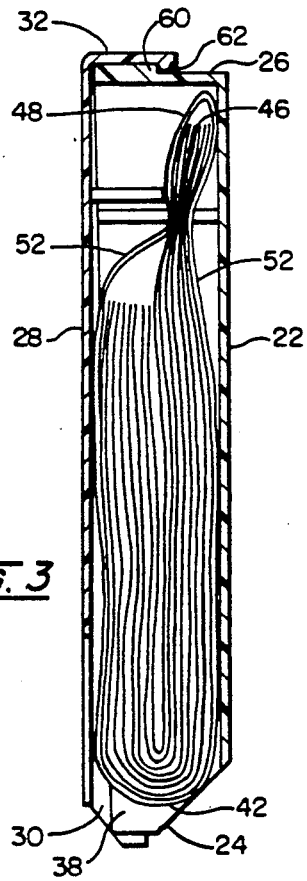
FIG. 3 is a side elevational view, in section of the dispenser shown in FIG. 1, the section being taken along the line 3—3 in FIG. 1.

A disposable glove dispenser constructed in accordance with the present invention is shown in FIGS. 1–3 and includes an outer rigid enclosure, indicated generally at 20. Enclosure 20 includes a rear wall 22, surrounded by side walls 24 and a top wall 26, and a front wall or cover 28. Cover 28 is provided with side walls 30 and a top wall 32. Side walls 30 and top wall 32 are adapted to closely fit over the upper edges of complementary walls 24 and 26 of rear wall 22.

Preferably, neither the rear wall 22 or front wall 28 includes a bottom wall. Front wall 28 is pivotally connected to rear wall 22 along the bottom edge of side walls 24 and 30 via pivot pins 34 fixed to each side walls 24.

Each side wall 30 of front wall 28 includes a U-shaped opening 36 which is conformed to slide over pivot pin 34 inside the enlarged head thereof as shown in the drawings in a light interference fit. This permits rotation of front wall 28 about pin 34, yet is convenient for easy assembly of rear wall 22 to front wall 28.

The lack of a bottom wall on either of the front or rear walls provides an exit opening 38 for retrieval of one glove at a time from a packet of gloves, indicated generally at 40, which is mounted within enclosure 20.

It is preferred to also provide an opening or window, such as 39, in front wall 28 which cooperates with bottom opening 38 to expose the packet of gloves for more convenient one at a time retrieval. However, alternately, solely the bottom opening 38 or solely a window similar to 39 could be used alone to create an exit opening to retrieve one glove at a time.

Now referring specifically to FIGS. 2 and 3, a packet of gloves 40, includes a plurality of conventional thin polyethylene gloves 42 arranged in closely overlying, parallel extending relationship to one another and to the front wall 28 and rear wall 22 to form a stack of gloves.

Each glove conforms generally to the shape of a human hand having fingers, palm and an extended wrist portion. A perforated tear line 44 is provided laterally across the extended wrist portion below the terminal end of each glove indicated at 46.

A header or mounting strip 48, comprising a relatively rigid or semi-rigid material, is disposed across the outermost glove in the aligned stack along a part of the extended wrist portion above tear line 44. Preferably mounting strip 48 is made of a paper board material or the like which is folded over the terminal end 46 of the stack of gloves 42 and extends downwardly over a portion of the outermost glove in the front and rear of the stack of gloves 42 as best seen in FIGS. 3. Each glove in the stack 42 is fixed to mounting strip 48 via staples 50. However, other conventional equivalent means to secure each glove to mounting strip 48 at a position above tear line 44 can be employed without departing from the present invention.

In order to conserve space and provide a compact design, it is desirable to arrange the stack of aligned gloves 42 with the finger portions, as a whole, folded upwardly and the thumb portions folded inwardly over the finger portions as best seen in FIGS. 2 and 3.

This arrangement also disposes the broader palm portion in an easily grasped disposition for retrieval one at a time through the openings 38 and 39 provided in enclosure 20.

To maintain the stack of gloves 42 in this folded configuration and for purposes of maintaining cleanliness during packaging and handling, a thin, outer polyethylene envelope 52 is disposed in surrounding relationship to the gloves 42 in the folded and stacked relationship described. Envelope 52 is fixed to mounting strip 48 in the same manner as the stack of gloves 42.

Packet 40, assembled as described above, is ready for insertion into enclosure 20. To mount the packet 40 in the enclosure 20, front cover 28 is pivoted to an open position, as shown in FIG. 2.

The side walls 24 of rear wall 28 are provided with inwardly directed protrusions or flanges 54 which function to slightly narrow the width between opposing side walls 24 to a dimension less than the width of mounting strip 48 and create a pocket conformed to receive mounting strip 48. The packet 40, including the gloves 42, is flexible to permit the portion thereof disposed immediately below mounting strip 48 to be force fit between the flanges 54. The remainder of packet 40 extends downwardly between side wall 24.

The outer envelope 52 is provided with a perforated circular area which can be easily removed to create an opening, such as shown at 56. Opening 56 preferably is disposed to extend over the bottom of envelope 52 with portions thereof extending on the front and rear faces of envelope 52. This provides convenient access to the outermost glove in the stack of gloves 42. This opening 56 in envelope 52 is disposed in alignment with both the openings 38 and 39 provided in enclosure 20 as previously described.

Upon placement of packet 40 as described above, front wall or cover 28 is pivoted to a closed position. Packet 40 is fixed against vertical displacement within enclosure 20 by a pair of inwardly directed posts 58 extending outwardly from the inner side of front wall 28. The length of posts 58 is adapted to engage mounting strip 48 to force mounting strip into force transmitting relationship against rear face 22 and cooperate with flanges 54 to resist vertical displacement of mounting strip 48 within enclosure 20.

To releasably secure front wall or cover 28 to rear wall 22, a conventional detent type latch is formed by an outwardly extending protrusion 60 provided on top wall 26 and a lip 62 provided on top wall 32. Protrusion 60 and lip 62 mately engage and disengage by forcing lip 62 past protrusion 58 as shown in FIG. 3 in the closed position.

The material used for enclosure 20, such as found in many conventional plastic materials formed in the thickness required for the intended purpose, provides sufficient resilience to permit this type of latch to operate effectively However, other forms of releasably securing the rear wall and front cover to one another in the closed position could be used without departing from the spirit of the present invention.

The rear wall 28 may include any conventional means, not shown, to permit convenient mounting of enclosure 20 on a vertical wall or frictional gripping means to promote stability when disposed on a horizontal surface.

Once enclosure 20 is loaded with a packet of gloves 40 as described, it should be readily understood that a user may reliably retrieve one glove at a time by merely grasping and pulling on the outermost glove 42 in the stack through openings 38 and 39. Since mounting strip 48 is restrained as described herein, a relatively modest force will separate the outermost glove along its respective tear line 44 to permit removal. If more than one glove is grasped, the force necessary to tear several gloves away is significantly greater than removing a single glove. In addition to the mounting relationship provided, this feature discourages inadvertently removing more than the desired single glove. When the packet 40 is exhausted of its supply of gloves 42, front wall 28 is pivoted open, the mounting strip 48 is removed and an identical packet 40 is replaced as described above herein.

While certain preferred embodiments of the present invention have been disclosed in detail, it is to be understood that various modifications may be adopted without departing from the spirit of the invention or scope of the following claims.

I claim:

1. A dispensing apparatus for disposable gloves comprising, in combination, a) a rear wall, front wall and opposing side walls forming a rigid enclosure means, said front wall being movable between open and closed positions, and an exit opening formed in at least one of said walls providing access to the interior of said enclosure means when said front wall is disposed in said closed position;

b) a packet removable mounted in said enclosure means and including a plurality of disposable gloves forming a stack disposed in closely overlying, parallel relationship to one another and to the walls of said enclosure means, said gloves having palm, finger and wrist portions conforming generally to the configuration of a human hand and provided with a weakened tear line extending across said wrist portion above said palm portion;

c) a mounting strip having a degree of rigidity significantly greater than said gloves and extending across the wrist portion of the outermost one of said gloves in said stack and including means for connecting the wrist portion of each glove in said stack above said tear line to said mounting strip, said mounting strip being disposed in parallel engagement with said rear wall in said enclosure means and spaced from said exit opening; and d) a protrusion formed on opposing side walls of said enclosure means, each protrusion directed inwardly toward one another to define a stop means resisting sliding movement of said mounting strip in a parallel direction relative to said rear wall toward said exit opening.

2. The dispensing means defined in claim 1 including at least one outwardly extending protrusion formed on an inner face of said front wall conformed to engage said mounting strip in force-transmitting relationship when said front wall is in said closed position to restrict movement of said mounting strip toward said exit opening.

* * * * *